US005570621A

United States Patent [19]

Kabasin

[11] Patent Number: 5,570,621

[45] Date of Patent: Nov. 5, 1996

[54] ADAPTIVE CONTROL FOR HYDRAULIC SYSTEMS

[75] Inventor: Daniel F. Kabasin, Rochester, N.Y.

[73] Assignee: General Motors Corporation, Detroit, Mich.

[21] Appl. No.: 319,701

[22] Filed: Oct. 7, 1994

[51] Int. Cl.[6] ..... F15B 9/09

[52] U.S. Cl. ..... 91/363 R

[58] Field of Search ..... 91/361, 363 R; 364/153, 157, 162

[56] References Cited

U.S. PATENT DOCUMENTS 4,881,160 11/1989 Sakai et al. ..... 364/157

4,951,549 8/1990 Olsen et al. ..... 91/361

5,043,862 8/1991 Takahashi et al. ..... 364/162

5,153,807 10/1992 Saito et al. ..... 364/157

*Primary Examiner*—F. Daniel Lopez

*Attorney, Agent, or Firm*—Michael J. Bridges

[57] ABSTRACT

An automotive hydraulic control system varies hydraulic fluid pressure applied to an actuator to position the actuator in accord with an automotive control application, the fluid pressure being generated in accord with a pressure command output from a hydraulic control function responsive to desired fluid pressure and to deviation in measured or estimated actuator transient response away from preferred actuator response to compensate for variations in hydraulic control system operating conditions.

5 Claims, 4 Drawing Sheets

150
Pf

UNDERDAMPED RESPONSE
152
Pf

OVERDAMPED RESPONSE
154
Pf

CRITICALLY DAMPED RESPONSE
156
Pf
tc ts1 ts2

ADAPTIVE CONTROL FOR HYDRAULIC SYSTEMS

FIELD OF THE INVENTION

This invention relates to automotive vehicle controls and, more specifically, to closed-loop control of an automotive hydraulic actuator.

BACKGROUND OF THE INVENTION

Automotive hydraulic control systems have been proposed in which the pressure of a control fluid, such as engine oil, is controlled for positioning of a hydraulic actuator. Control fluid viscosity can vary significantly with fluid temperature and age. Control fluid pressure can vary significantly during even one control cycle. Variations in fluid viscosity and pressure significantly affect dynamic hydraulic control performance. Accordingly, some attempt has been made to estimate control fluid viscosity and pressure and vary control gains in response thereto. For example, control fluid age, temperature and pressure have been measured or estimated and the temperature and age estimations used to estimate fluid viscosity, and the estimated viscosity and pressure used to vary control gains. Such complex sensing, estimating and processing yields some improvement in dynamic hydraulic control system performance.

However, control fluid temperature, age and pressure are only three of many factors that may affect dynamic hydraulic control performance. Furthermore, fluid temperature and pressure sampled at one point in a hydraulic system may not reflect accurately the temperature and pressure of the control fluid a short distance away or a short time later. Still further, the relationship between estimated or measured fluid age and change in fluid viscosity may be difficult to accurately characterize. Still further, use of temperature, age and pressure sensors or estimators adds to control system cost and complexity.

SUMMARY OF THE INVENTION

The present invention overcomes the shortcomings of the prior art through a hydraulic control system providing compensation for variations in all factors, including fluid temperature, age, and pressure that can lead to variation in hydraulic actuator dynamic control performance, such as transient response performance, in a simple compensation approach that adds no additional sensors over typical systems.

More specifically, the present invention directly measures the dynamic performance of a hydraulic actuator and compensates the hydraulic control system for dynamic performance deviations away from preferred actuator performance. Variations in oil viscosity, from any cause, and variations in oil pressure, that impact dynamic performance will be manifest in the measurement in the form of a variation in actuator transient response. Compensation may then be applied to drive the dynamic performance of the actuator toward a desired performance characteristic, regardless of the source of the variation.

In accord with a further aspect of this invention, the feedback signal may be provided through a conventional position feedback measurement of hydraulic actuator position. Sensors are commonly used in hydraulic control systems to measure actual actuator position, and may be easily and inexpensively adapted for use in accord with this invention. Further parameter sensing would not be necessary for viscosity or pressure compensation in the closed-loop control system, nor would the sensing or estimating of any other parameter that may impact closed-loop control performance, reducing significantly system cost and complexity.

In yet a further aspect of this invention, non-intrusive performance measurement is provided by only analyzing dynamic performance when certain system operating conditions are present through the course of normal system operation. A significant step change in commanded actuator position may, in accord with this aspect of the invention, be required before performance analysis may be made so as to most accurately characterize and compensate for changes in system transient response.

BRIEF DESCRIPTION OF THE DRAWINGS

The invention may be best understood in reference to the preferred embodiment and to the drawings in which.

DESCRIPTION OF THE PREFERRED EMBODIMENT

Figure 1:
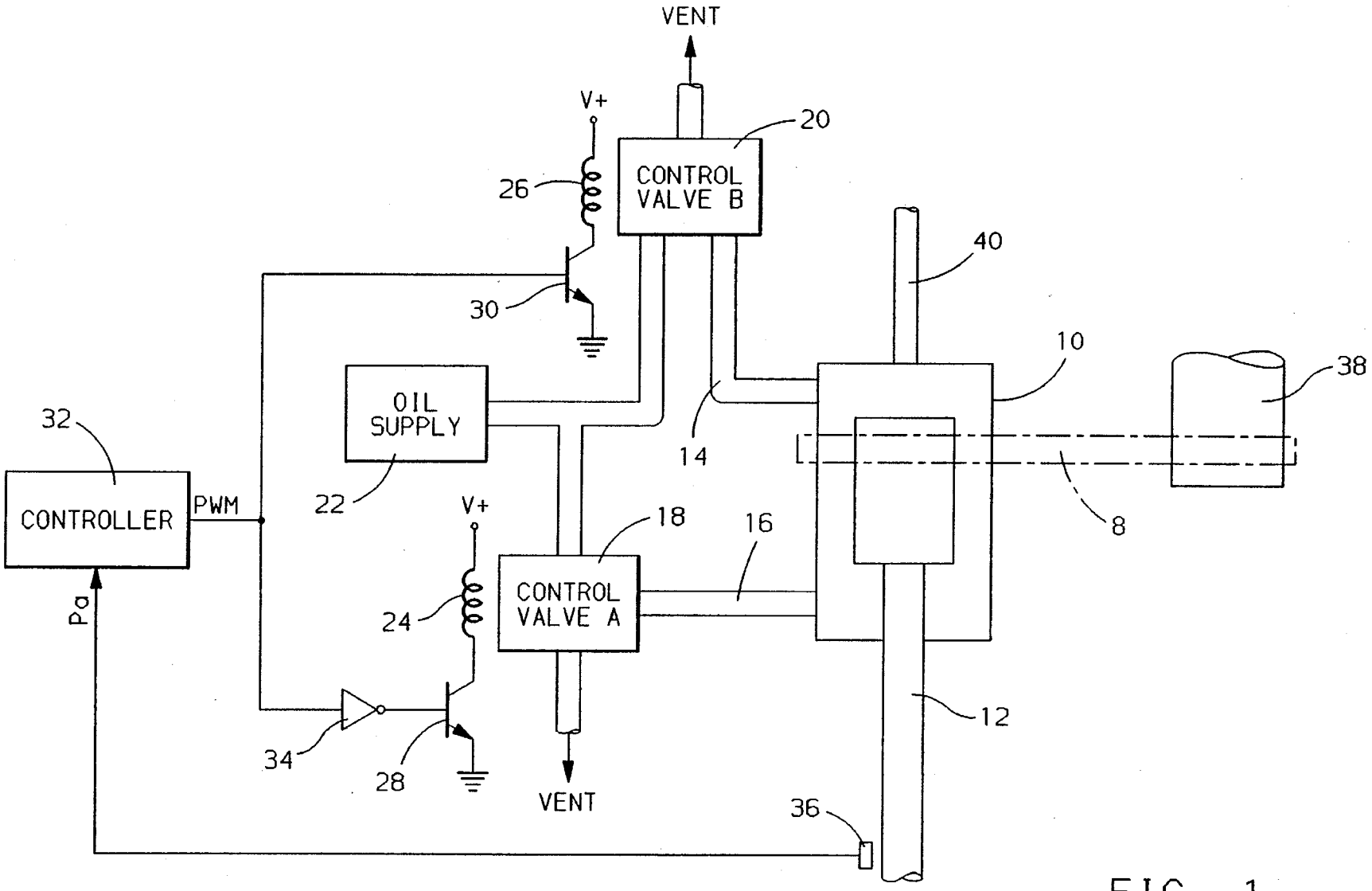
FIG. 1 is a general illustration of the hydraulic control system hardware of the preferred embodiment in an automotive application.

Referring to FIG. 1, a hydraulic control system is provided to control the position of a hydraulic actuator 12 such as a piston, to provide for linear positioning thereof along a range of motion. The piston 12 may move in this embodiment bi-directionally, wherein hydraulic fluid pressure is applied to a first side of the piston 12 from hydraulic fluid admitted through passage 14 to a first side of the piston, and may move in a reverse direction of motion from pressure applied by hydraulic fluid passing through a second passage 16. The piston may move, as influenced by hydraulic pressure applied thereto, along a sleeve (not shown) attached to a phasing device 10, wherein the phasing device may be of conventional design for varying the angular relationship between a crankshaft and camshaft as is generally understood in the art. For example, the piston 12 may be attached, such as via a conventional paired block configuration or a conventional helical spline configuration, to a toothed wheel (not shown), on which is disposed a chain 8 linked to an engine crankshaft 38. The phaser 10 may then be fixedly mechanically linked to a camshaft 40. A control valve A 18 and a control valve B 20 are positioned to admit a varying quantity of hydraulic fluid through respective first and second passages 14 and 16 to respective first and second sides of piston 12 to apply pressure to such sides wherein the relative pressure applied to the first and second sides of piston 12 determines the steady state position of the piston. Precise piston positioning along a continuum of positions within the sleeve of phaser 10 is provided through precise control of the relative position of control valves A 18 and B 20. The control valves receive hydraulic fluid, such as conventional engine oil, from an oil supply 22 such as an oil pump which draws hydraulic fluid from a reservoir and passes the fluid to an inlet side of each of the control valves at a substantially regulated pressure. The control valves 18 and 20 may be conventional three-way valves having linear, magnetic field-driven solenoids, positioned in accord with the level of current passing through corresponding coils 24 and 26. In a rest position, the solenoid of control valves 18 and 20 is positioned so that the fluid inlet to the valve is completely vented out of the valve away from piston 12, so that the piston position is not influenced by fluid pressure. As the valves 18 and 20 are actuated away from their rest positions through passage of current through the corresponding control valves A 18 and B 20, a portion of the vented fluid is directed to the corresponding side of piston 12 to apply a hydraulic force thereto, to displace the piston away from its rest position in accord with the relative fluid pressure force applied across the piston. A substantially linear relationship exists between valve current and hydraulic pressure applied to the piston 12. The force applied to the piston may generally be expressed as hydraulic pressure multiplied by piston area. In the embodiment of this invention in which piston 12 is linearly actuated in accord with the relative pressure thereacross, the piston 12 will be displaced in a first direction when control valve A 18 is supplying a more significant fluid pressure through passage 16 than is control valve B 20 through its passage 14, and will be displaced in a second direction when control valve B 20 is supplying the more significant fluid pressure. In the present embodiment in which the piston is positioned along a substantial continuum of positions, so as to vary the angular relationship between crankshaft 38 and camshaft 40 in accord with generally understood automotive phasing techniques, variable valve timing is provided by varying the linear displacement of piston 12 within phaser 10. Examples of such phasing hardware may be generally found in U.S. Pat. Nos. 5,119,691, 5,033,327, and 5,163,872 assigned to the assignee of this application.

Pulse width modulation PWM control is provided for current control through coils 24 and 26, wherein a fixed frequency, fixed amplitude, variable duty cycle signal is passed to switch 30 in uninverted form, and is passed in inverted form, via inverter 34, to switch 28. The switches 28 and 30 may be common transistors and the PWM signal applied to the base thereof, wherein the transistors conduct from collector to emitter when the PWM signal applied to the base thereof is high, and do not conduct otherwise. The inverting of signal PWM via inverter 34 provides that only one switch or transistor will be conducting at any time during the hydraulic control of this embodiment.

Switches 28 and 30 are connected between a low side of corresponding coils 24 and 26 and a ground reference. The high side of coils 24 and 26 opposing the low side of such coils, is electrically connected to a supply voltage V+, of approximately twelve volts in this embodiment. Accordingly, when the switch 28 or 30 is conducting, current will be increasing exponentially in the corresponding coil toward an average current that is a predetermined function of the voltage across the coil and coil resistance. Alternatively, when such switch is not conducting, such as during the off-portion of each PWM cycle, current will be exponentially decaying in the corresponding coil toward zero. The corresponding valve will be held, for a given duty cycle, substantially at a fixed position corresponding to the average current in the coil, as is generally understood in the solenoid control art. The frequency of the PWM signal should be set high enough that piston position is stable for a fixed PWM value, wherein, for a fixed PWM value, the changing current through each of the coils 24 and 26 does not lead to any significant variation in piston position. Calibration of the hydraulic control system, wherein the electrical damping provided through coils 24 and 26 and hydraulic fluid damping may be accounted for, may yield information on a sufficiently high PWM frequency that may be used to provide for such stability.

The position of the piston 12 actuated through the control of this embodiment is sensed through conventional position sensor 36, positioned in proximity to piston 12 to sense the piston displacement and to output a signal PA indicative thereof which is received by controller 32 to provide for the control in accord with this invention. Controller 32 may be a simple single chip micro-controller having such conventional controller elements as a central processing unit, non-volatile and volatile memory units, input/output units, and other units generally known in the art to be used for vehicle control operations. Generally, the controller, through execution of periodic control operations, senses the response of the piston 12 to control commands issued in the form of PWM commands, to determine hydraulic lag in the hydraulic control system of FIG. 1 and to adjust the PWM command in a controlled manner to overcome such hydraulic lag, to provide a most responsive position control of piston 12 without oscillation, significant overshoot, or significant response delay, such as through providing for critically-damped hydraulic control.

Figure 2:
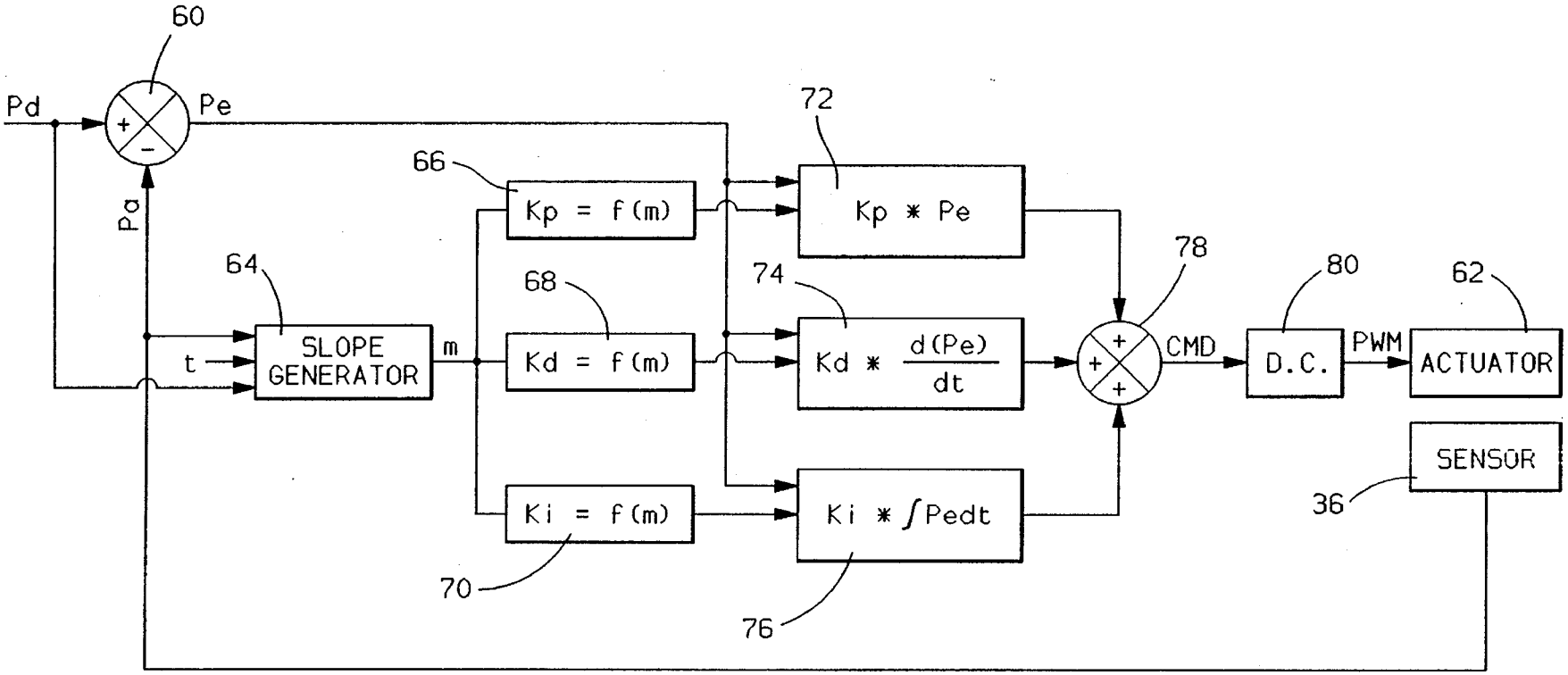
FIG. 2 is a block diagram of the hydraulic control system of the preferred embodiment.

Such control operations may be described through the general control function as diagrammed in FIG. 2, in which control command Pd generated by controller 32, for example as a predetermined function of such engine parameters as engine speed, load or intake pressure, and in accord with a desired phasing between the camshaft and crankshaft of a system to which the control function is applied, is provided to summing node 60. Sensed piston position signal Pa from sensor 36 is likewise applied in negated form to summing node 60, so to be subtracted from signal Pd to form a position error signal Pe, to be minimized in accord with the control function of FIG. 2. Signals Pd and Pa are also applied to slope generator 64 which, in this embodiment, generates m, a rate of change of Pa over a predetermined period of time. In alternative embodiments of this invention, slope generator may measure the responsiveness of the actuator 62 to a change in commanded actuator position. Actuator 62 of FIG. 2 simply represents the hydraulic actuator controlled in accord with this invention, such as the piston 12 of FIG. 1.

For example, a comparison between an amount of change in the value CMD and a resulting amount of change in sensed actuator position Pa over a predetermined transient response period of time may be used to generate a transient response transfer function providing the responsiveness measure. As another example, the rate of reduction of any significant position error Pe in the system may indicate system responsiveness in accord with this invention.

Returning to FIG. 2, the slope generator 64 provides output signal m representing the time rate of change or other responsiveness measure of actuator 62, for use in adjusting control responsiveness in accord with this invention. For example, in this embodiment for illustrating and not for limiting the invention, in which proportional plus derivative plus integral PID control is used to drive actual actuator position Pa toward desired or commanded actuator position Pd, the value m is provided to control blocks 66, 68, and 70 at which control gains Kp, Kd, and Ki are adjusted as predetermined functions of the value m. Such functions may be simple linear relationships between magnitude of m and control gain magnitude, wherein gain magnitude increases with increasing m and decreases with decreasing m. Further detail on such linear relationships would be provided through a conventional calibration process for a given system to provide appropriate and desirable control responsiveness adjustment. Alternatively, such functions may be more complex non-linear functions describing detailed non-linear relationships between sensed or estimated system responsiveness and desired adjustment in control responsiveness. Further, such functions may correspond to very simple incremental increases or decreases in control gains. For example, the gains may be increased by a fixed amount whenever the system responsiveness measure is too low, such as below a predetermined threshold, and the gains may be decreased by a fixed amount whenever the measure is too high, such as above a predetermined threshold.

In other embodiments of this invention in which other known control strategies, such as nonlinear or modern or adaptive or optimal strategies are substituted, through ordinary skill in the art, for the present PID strategy, the responsiveness of the control may be varied in accord with this invention through other conventionally understood means. Returning to FIG. 2, the slope generator 64 may operate only upon determination that a significant change in Pd has occurred over a predetermined time period so that a measurement of the responsiveness and thus of the hydraulic lag of the system of this embodiment may be measured or estimated.

The control gains, following any adjustment thereto at the blocks 66–70, are applied to the position error Pe to derive proportional, derivative, and integral actuator position command corrections at the respective blocks 72, 74, and 76 in accord with generally understood PID control practice. The corrections are then applied to summing node 78 to form an actuator command CMD for driving actuator 62 position toward the desired position represented by signal Pd, as described. The command CMD is then applied to block 80 to reference a corresponding duty cycle for the PWM command applied to actuator 62. Block 80 may simply represent a lookup table in controller non-volatile memory in which a schedule of PWM duty cycle values is stored so as to be referenced as the duty cycle capable of driving the actuator 62 as commanded by CMD.

The control operations making up the function of FIG. 2 may be carried out as a series of step by step computer operations periodically executed by an operating controller, such as while the hydraulic control system of FIG. 1 is operating. This series of operations may take the form of a number of interrupt service operations executed upon occurrence of a conventional timed-based controller interrupt. The time-based interrupt may be set up to occur approximately every four milliseconds while the controller 32 of FIG. 1 is operating.

Figure 3:
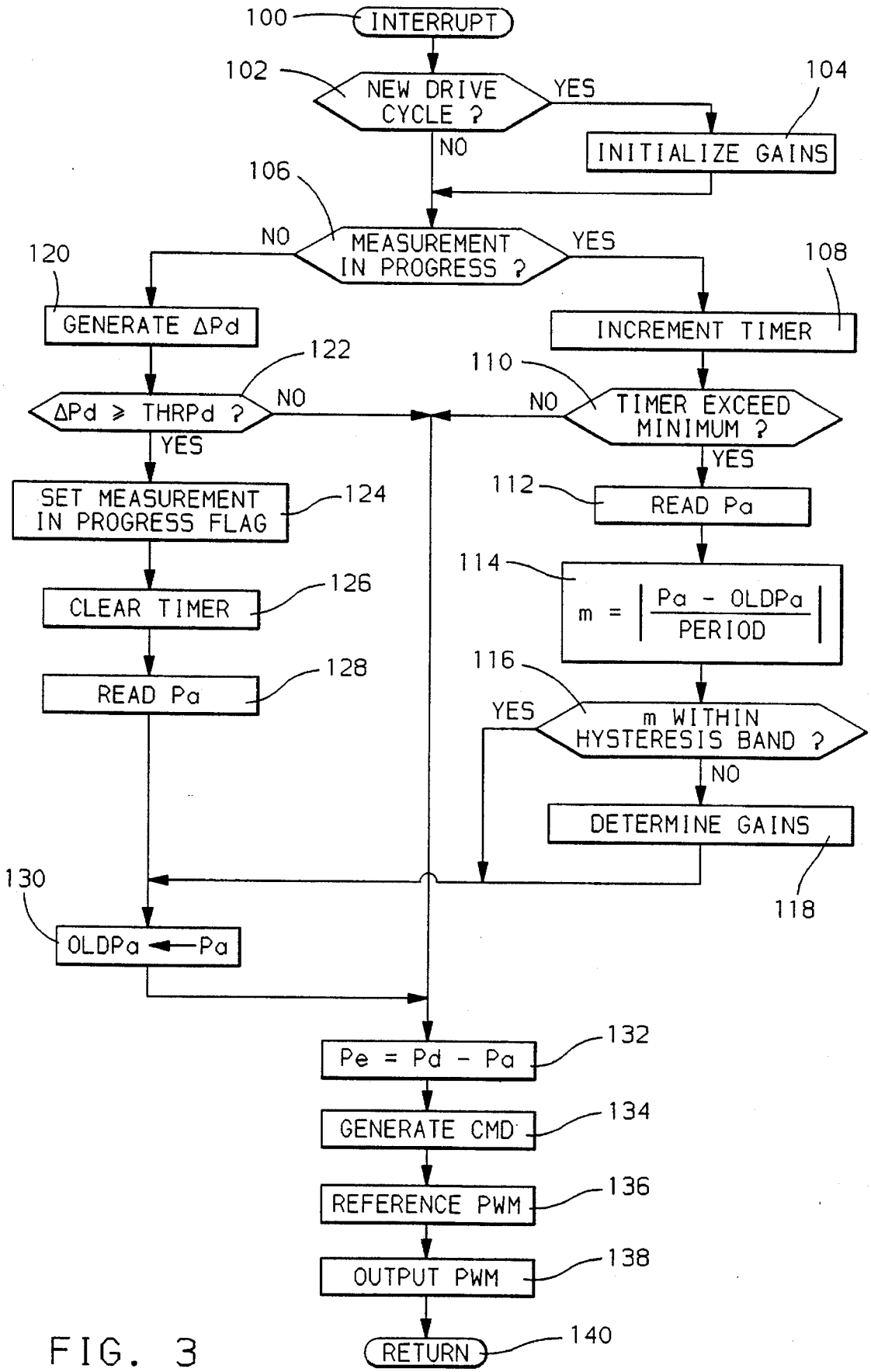
FIG. 3 is a computer flow diagram illustrating a step by step procedure for carrying out the control function described in FIG. 2 in accord with the preferred embodiment.

Upon occurrence of the time-based interrupt, the controller may temporarily postpone any current controller operations, and may begin the interrupt service routine of FIG. 3 starting at a step 100 and proceeding to a step 102 to determine, such as from the status of a flag in controller memory, if a new drive cycle is underway. A new drive cycle is, in this embodiment, a new cycle of hydraulic control following a period of control inactivity, such as a period during which power is not applied to activate controller 32. When the controller is first powered up in a new drive cycle as determined at the step 102, initialization must occur and is carried out by moving from the step 102 to a step 104 to initialize control gains KP, KI and KD to a set of predetermined initial values and to adjust the value of a flag in controller memory to remove a new drive cycle indication. The initial values of KP, KI, and KD may be learned from a previous drive cycle, such as by storing prior adjusted values thereof in controller non-volatile memory and referencing such stored values at the step 104. The predetermined initial values for the control gains may be provided through a calibration of the system to provide a control response from the control function of FIG. 2 that is no worse than a critically-damped control response. In other words, initial values for the gains should be selected to provide a response that may be slightly slower than the critically-damped response of the control function of FIG. 2, but does not provide for significant oscillation in the actuator transient response.

After setting the gains to initial values at the step 104, or if the drive cycle is not a new drive cycle as determined at the step 102, the routine proceeds to a step 106 to determine if a measurement of slope m is currently in progress. In this embodiment, the measurement of slope occurs over a predetermined number of samples of the value Pa from sensor 36. During the measurement of such values and the calculation of slope therefrom, the routine moves from the step 106 to steps 108–118 to carry out the measurement. However, if the measurement is not in progress, the routine proceeds from the step 106 to a step 120 to analyze a pre-condition required to be present before such measurement may commence. Specifically, a value ΔPd is generated at the step 120 which represents a magnitude of change in Pd over a predetermined period of time, such as over two most recent iterations of the routine of FIG. 3 in this embodiment. The measure ΔPd provides information on the degree of desired actuator position change over a time period. If this degree of change is sufficiently large, the transient response of actuator 62, such as piston 12 of FIG. 1 may be measurable. Accordingly, if the ΔPd generated at the step 120 exceeds a threshold value THRPd at a step 122, the measurement of transient response may be made, by proceeding to a step 124. The threshold value THRPd may be determined through calibration as the minimum change in Pd that may give rise to a significant transient response of actuator 62 of FIG. 2 so that measurement of such responsiveness may be made in accord with this invention. If ΔPd does not exceed this threshold at the step 122, the routine moves to a step 132, to be described.

Returning to the step 124, to start the measurement process, a measurement in progress flag is set in controller memory, and the routine then moves to a step 126 to clear a timer used for transient response measurement timing as will be described. The routine then proceeds to a step 128 to read Pa, the actual sensed piston position of the hydraulic actuator of this embodiment such as through the described operation of sensor 36 of FIG. 1. The routine next proceeds to a step 130 to store the sensed Pa value as OLDPa in controller memory for later use. Next, the routine proceeds to steps 132–138 to carry out closed-loop actuator position control, to be described.

Returning to the step 106, if a measurement is determined to be in progress, the routine proceeds to a step 108 to increment a timer used to record the actual time between samples of Pa. The routine then proceeds to a step 110 to determine if the timer exceeds a minimum time value, such as approximately 100 milliseconds in this embodiment. If the timer does not exceed the minimum time value, then an insufficient time between samples has not yet elapsed, and the routine proceeds to the step 132, to be described. In this manner, the timer may be used to precisely time, to within one interrupt period, the taking of samples for use in measuring or estimating transient performance of actuator 62, so as to measure and ultimately compensate for hydraulic lag variations in accord with this invention. The time allowed to elapse between samples of Pa, and the number of samples taken may vary within the scope of this invention. The invention merely requires some measure or estimate of the performance of the system in driving the actuator 62 toward a desired linear or rotational position, and is not intended to be limited to any specific performance measurement approach, as a wide variety of measurement approaches are available without undue experimentation through application of ordinary skill in the art.

Returning to the step 110, if the timer does exceed the minimum, such that another sample of Pa may now be taken, the routine proceeds to a step 112 to sample the Pa value from sensor 36 and store it in controller memory. The routine then proceeds to determine a performance measure, such as a slope value m at a step 114. The value m may be established by determining the magnitude of the time rate of change of sampled consecutive Pa values over a sampling period. Alternatively, a number of calculations may be carried out at the step 114 using samples of Pa over a predetermined number of sampling intervals to determine a transient response of the actuator 62 of FIG. 2, such as the piston 12 of FIG. 1, in response to a change in Pd or, in alternative embodiments, to a change in CMD. For example, a transfer function may be formally described at the step 114 wherein the actual time rate of change in position over the commanded time rate of change in position may be carried out through a more detailed equation to determine hydraulic lag in the system which may also include any mechanical lag or electrical lag that may impact the responsiveness of the system to a commanded time rate of change in actuator position. However, in the preferred embodiment of this invention which is provided only as an illustration of this invention and not to limit this invention, the slope m or the time rate of change in the transient response of the actuator, is represented as a simple magnitude of change of sampled Pa values over a period of time, such as approximately 100 milliseconds After calculating the slope m at the step 114, the routine proceeds to a step 116 to restrict change in the control gains to cases in which slope m is outside a hysteresis band, so as to avoid unnecessary control gain changes. For example, control gain changes are avoided when slope m is such that acceptable control performance may be provided through the PID control action of the control system with the existing gains. The hysteresis band may be established through a conventional calibration of the control system to include slope m values for which acceptable control system response may be provided without adjustment of the gains KP, KI, and KD. Returning to step 116, if the slope m is not within the hysteresis band, the routine moves to a step 118 to determine control gains used in the control function of this embodiment. For example, in this embodiment, a PID control function is employed to provide for closed-loop actuator position control. Accordingly, gains of Kp, Kd and Ki are used in such control, as described. Values for such gains may be determined at the step 118 as predetermined functions of the determined, limited slope m. Such gains may be determined by providing a predetermined function stored in controller memory for each of the gain values. The functions may be established through a conventional calibration process for the system of this embodiment, by determining the changes in the PID gain values of the control function of FIG. 2 that best provide for a change in transient response that may be needed to overcome any unsatisfactory transient performance measurement made in accord with this embodiment.

Figures 4A, 4B, 4C, 4D:
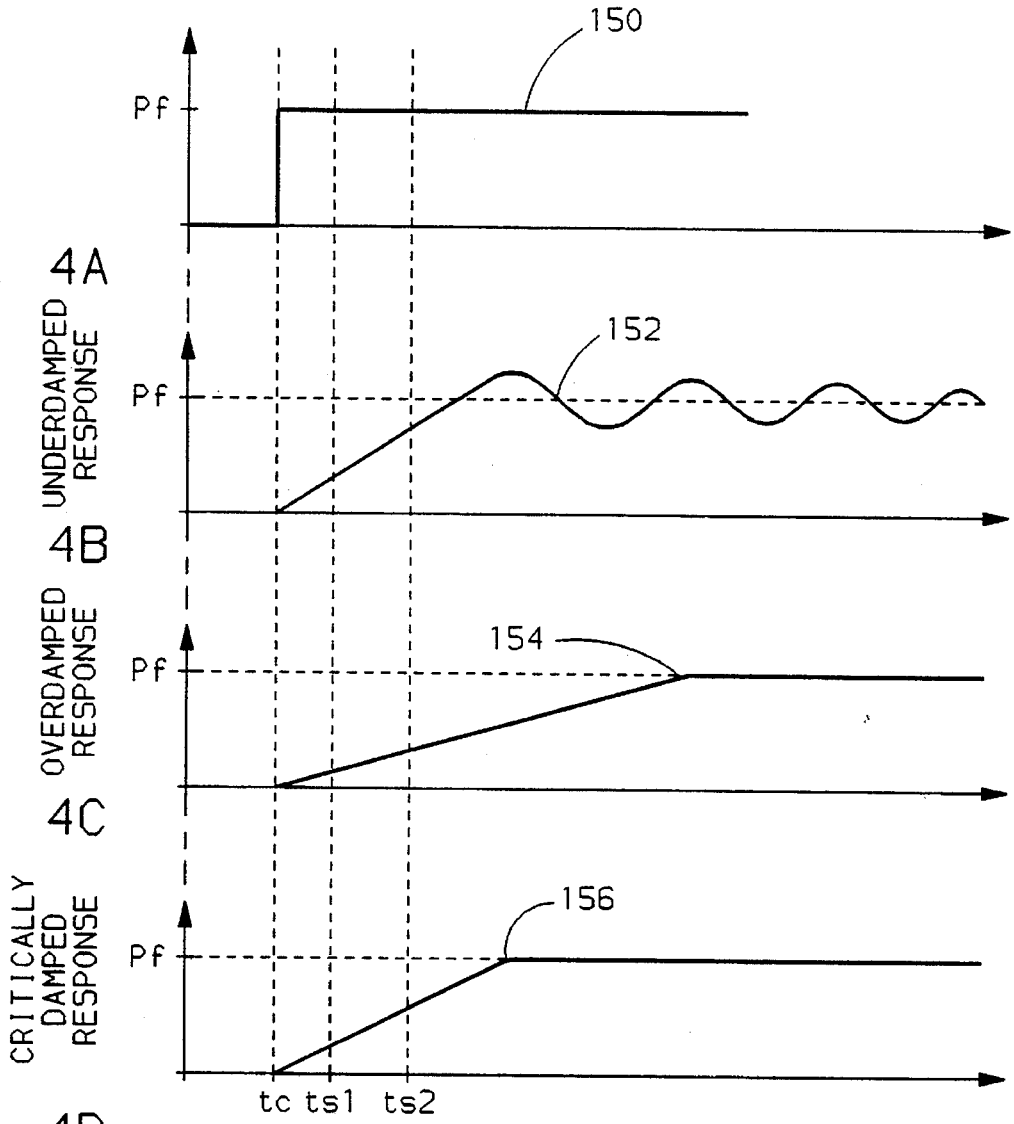
FIG. 4 is a series of graphs illustrating typical dynamic response of a hydraulic actuator under control of the system of FIG. 2.

For example, FIG. 4 illustrates transient performance under a number of hydraulic lag scenarios that may be compensated through this invention. As step change in Pd occurs at time tc from an initial value to a final value Pf 150, the underdamped response 152 rapidly rises to the desired final value Pf but then overshoots significantly the value Pf and oscillates around the final value reflecting an undesirable transient response which requires significant time to resolve the final position Pf. In such a case of underdamped control the gains Kp, Kd and Ki may, in this embodiment, be too high and would be reduced in accord with the present invention to increase damping and thus increase the stability of the transient response. Samples of response signal 152 taken at times ts1 and ts2 would indicate a rapidly rising Pa value corresponding to an underdamped response which could be adjusted for as described. The underdamped response may result from an increase in fluid pressure or a decrease in hydraulic fluid viscosity, such as from an increase in fluid temperature, resulting in a decrease in net damping of actuator 62 of FIG. 2. Control damping may then be increased to compensate for such decrease in net damping.

In the case of an overdamped response 154 of FIG. 4 in which samples taken at times ts1 and ts2 would indicate a very slowly responding actuator 62 to a step change in Pd 150 at a time tc, the control gains may be interpreted as being too low and may be increased in a controlled manner in accord with this invention. While the overshoot and oscillation conditions of the underdamped response 152 are not present for the overdamped response 154, the sluggish overdamped response is undesirable in many typical control applications, such as that of this preferred embodiment. Accordingly, compensation for such sluggishness is desired. By increasing the control gains, control damping would be reduced, and overall actuator damping would be compensated in accord with this invention. The overdamped response would correspond to a condition in which the viscosity of the hydraulic fluid used in the control system of FIG. 1 may have increased over a prior value or over an expected value, such as due to a fluid temperature decrease, or fluid aging, or a fluid pressure decrease, which would increase net damping of actuator 62 of FIG. 2.

In the critically damped response 156 of FIG. 4 to the step change in Pd 150, samples of signal Pa taken at times ts1 and ts2 would indicate a properly responding piston 12 or hydraulic actuator 62 to the step change Pd, and no corresponding change to the control gains would be required. As is generally known in the control art, in the critically damped response, the final desired actuator position is rapidly achieved without significant overshoot or oscillation as is preferable in transient response control. The control damping adjustment made in accord with this invention should attempt to drive the actual sensed response toward such critically damped response. The response 156 may reflect hydraulic fluid pressure and viscosity substantially at a design pressure and viscosity, or may reflect the effect of compensation provided through this invention to a system having fluid with a wide variety of pressures and viscosities.

Returning to FIG. 3, after determining control gains at the step 118 in accord with predetermined functions which may be set up as conventional lookup tables referenced in accord with the determined slope m, or if the slope m is within the hysteresis band at the step 116 in which case no such adjustment of the control gains is necessary, the routine proceeds to the described step 130. Following the step 130, or after a negative decision at the described steps 110 or 122, the steps 132–138 are executed to provide for conventional closed-loop actuator position control operations. First at a step 132, a position error Pe is determined as a predetermined function of desired position Pd and actual measured position Pa, such as by simply subtracting PA from PD in this embodiment. The routine moves next to a step 134 to generate a command CMD as a predetermined function of the position error as follows:

$$CMD=Kp*Pe+Ki*\int Pe(dt)+Kd*d(Pe)/dt$$

in accord with generally understood PID control principles.

After generating the command CMD at the step 134, the routine proceeds to a step 136 to reference a PWM value corresponding to the generated command, as the calibrated pulse width modulation duty cycle that will provide for the position command CMD for proper actuator positioning. In this embodiment in which hydraulic actuator is piston 12 of FIG. 1, the relationship between PWM commands and piston positions must be calibrated using the information available on the relationship between piston position and relative pressure applied to each side of the piston from the first and second control valves 18 and 20 of FIG. 1. After referencing the appropriate PWM value, such as from a lookup table calibrated and stored in controller memory, the routine proceeds to a step 138 to output the PWM value to control valve A 18 and control valve B 20 of FIG. 1. The PWM value that is output at the step 138 may be output immediately to such actuators or may be delayed by an appropriate amount of time predetermined to provide a desired position control response according to the response requirements of the hydraulic system. After outputting the PWM value at the step 138, the routine proceeds to a step 140 to return from the interrupt service routine of FIG. 3 to controller operations that may have been temporarily postponed upon occurrence of the interrupt that invoked the routine of FIG. 3.

The preferred embodiment for the purpose of explaining this invention is not to be taken as limiting or restricting this invention since many modifications may be made through the exercise of ordinary skill in the art without departing from the scope of this invention.

The embodiments of the invention in which a property or privilege is claimed are described as follows:

1. A control method for controlling automotive hydraulic actuator position by controlling hydraulic pressure applied to the actuator in accord with a commanded pressure generated by a hydraulic control function, comprising the steps of:

measuring actuator transient response, by (a) sensing actuator position, and (b) generating a value representing time rate of change in actuator position as an indication of actuator transient response;

comparing the measured actuator transient response to a preferred transient response; and adapting the hydraulic control function when the measured actuator response deviates from the preferred transient response to drive the measured response toward the preferred transient response.

2. A control method for controlling automotive hydraulic actuator position by controlling hydraulic pressure applied to the actuator in accord with a commanded pressure generated by a hydraulic control function, comprising the steps of:

detecting a change in a desired position value applied to the hydraulic control function;

comparing the detected change to a predetermined change threshold value;

measuring actuator transient response only when the detected change exceeds the predetermined change threshold value;

comparing the measured actuator transient response to a preferred transient response; and adapting the hydraulic control function when the measured actuator response deviates from the preferred transient response to drive the measured response toward the preferred transient response.

3. A control method for controlling automotive hydraulic actuator position by controlling hydraulic pressure applied to the actuator in accord with a commanded pressure generated by applying a desired position value to a hydraulic control function, comprising the steps of:

measuring actuator transient response to a change in commanded pressure, by (a) determining when the actuator is moving in response to a change in the desired position value, (b) measuring the amount of actuator displacement during a predetermined time interval during which the actuator is determined to be moving, and (c) measuring the transient response as a predetermined function of the measured amount of displacement and the predetermined time interval;

comparing the measured transient response to a desired transient response;

when the measured transient response deviates from the desired transient response, compensating the control function to drive the transient response toward the desired transient response, by (a) determining at least one control function gain adjustment value as a predetermined function of the measured transient response, and (b) applying the at least one control function gain adjustment value to the control function to compensate the control function.

4. A control method for controlling the position of a hydraulically-driven piston in an automotive hydraulic variable cam phaser in which hydraulic pressure is controlled in accord with a position command generated through a closed-loop control function having at least one control gain and responsive to a piston position error signal, comprising the steps of:

detecting a change in the position command;

determining when the detected change exceeds a predetermined threshold command change;

sensing actuator position;

generating a time rate of change in actuator position after determining that the detected change exceeds the threshold command change;

referencing at least one stored control gain as a predetermined function of the time rate of change;

compensating the control function by applying the at least one referenced control gain to the control function; and controlling hydraulic pressure in accord with the compensated control function.

5. The method of claim 4, further comprising the steps of:

estimating a preferred value representing a preferred time rate of change in actuator position;

determining a change difference between the preferred value and the generated time rate of change; and establishing a schedule of control function gains referenced in accord with a corresponding schedule of change differences wherein the gains are established to compensate the control function in direction to drive the corresponding change difference toward zero; and wherein the referencing step references at least one control function gain as the gain in the established schedule corresponding to the determined change difference.

* * * * *